US005199332A

United States Patent [19]

Batten

[11] Patent Number: 5,199,332

[45] Date of Patent: Apr. 6, 1993

[54] HAND WRENCHING TOOL

[76] Inventor: Ronald W. Batten, 5618 White Ct., Torrance, Calif. 90503

[21] Appl. No.: 191,619

[22] Filed: Aug. 3, 1988

Related U.S. Application Data

[63] Continuation of Ser. No. 939,144, Dec. 8, 1986, abandoned.

[51] Int. Cl.[5] ..... B25B 13/02

[52] U.S. Cl. ..... 81/124.1; 81/63.2

[58] Field of Search ..... 81/63.2, 124.1, 124.4, 81/124.5, 121.1, 60, 61, 62, 63

[56] References Cited

U.S. PATENT DOCUMENTS 2,470,399 5/1949 Holben ..... 81/124.1
2,651,229 9/1953 Lenz ..... 81/124.1
4,328,720 5/1982 Shiel ..... 81/63

*Primary Examiner*—M. Rachuba
*Attorney, Agent, or Firm*—Plante, Strauss & Vanderburgh

[57] ABSTRACT

A socket wrench with an ejector for severed collars of frangible fasteners has a conventional box ratchet wrench with a socket sleeve distally carried on the wrench body. The sleeve has a through aperture having internal flats and an internal lip at one end. The ejector member has an external diameter closely conforming to the internal diameter of the sleeve and slidably received therein. The cylindrical ejector has an annular shoulder intermediate its length and a ring permanently secured to its opposite end, with the sleeve lip captured between the ejector shoulder and ring. As the ejector is slidably mounted in the sleeve, it can be depressed into the socket, ejecting the threaded collar of the frangible fastener.

9 Claims, 3 Drawing Sheets

HAND WRENCHING TOOL

BACKGROUND OF THE INVENTION

1. Field of the Invention

This invention relates to a wrenching tool, and in particular to a hand tool useful for installation of frangible fasteners.

2. Brief Statement of the Prior Art

Frangible fasteners are used extensively in the aerospace industry. These fasteners employ a threaded nut member which has a threaded collar and a distal wrenching ring joined by a neck with a notched section which shears from the collar when the applied torque exceeds a predetermined torsional loading. Often the threaded collar has an upset portion, usually a slightly elliptical shape, to provide a frictional spring lock that prevents the fastener from spinning off in the event that the residual tension on the fastener is lost.

These fasteners are usually applied with power driven wrenching tools which engage the distal wrenching ring to apply the threaded collar and twist the wrenching ring from the threaded collar when the predetermined torsional loading is exceeded.

In many applications, it is often desirable to have a small hand tool which can be used to apply the frangible fasteners. Although the frangible fasteners have a conventional hexagonal flatted wrenching collar, which will fit conventional socket wrenches, use of a conventional socket wrench to apply the frangible fasteners in not entirely suitable. The wrenching collar is considerably more narrow than conventional nut fasteners, and with most socket wrenches, there is a tendency for the socket to cant on the wrenching collar, resulting in jamming of the wrenching collar in the socket. Even when the wrenching collars do not jam in the socket, they are often snugly received in the sockets and must be forcefully ejected therefrom often by inserting a probe into the socket to force the wrenching collar from the socket.

It is thus desirable to provide a simple attachment for conventional socket wrenches whereby the sockets of these wrenches will readily receive the wrenching collar of frangible fasteners without the danger of jamming, and will permit facile ejection of the severed collar from the wrenching tool.

BRIEF DESCRIPTION OF THE INVENTION

This invention comprises a socket wrench with an ejector for severed collars of frangible fasteners. The socket wrench is a conventional box ratchet wrench with a socket sleeve distally carried on the wrench body. The socket sleeve has a through aperture having internal flats and an internal lip at one end. The ejector of the invention comprises a cylindrical ejector member having an external diameter closely conforming to the internal diameter of the socket sleeve and slidably received therein. The cylindrical ejector member has an annular shoulder intermediate its length and, at its opposite end, has a ring permanently secured thereto with the internal lip of the socket sleeve captured between its annular shoulder and ring, thereby permanently retaining the cylindrical ejector member in the socket sleeve. As the cylindrical ejector member is slidably mounted in the socket sleeve, it can be depressed into the socket, ejecting a threaded collar received therein.

BRIEF DESCRIPTION OF THE DRAWINGS

The invention will be described by reference to the figures of which.

DESCRIPTION OF PREFERRED EMBODIMENT

Figure 1:
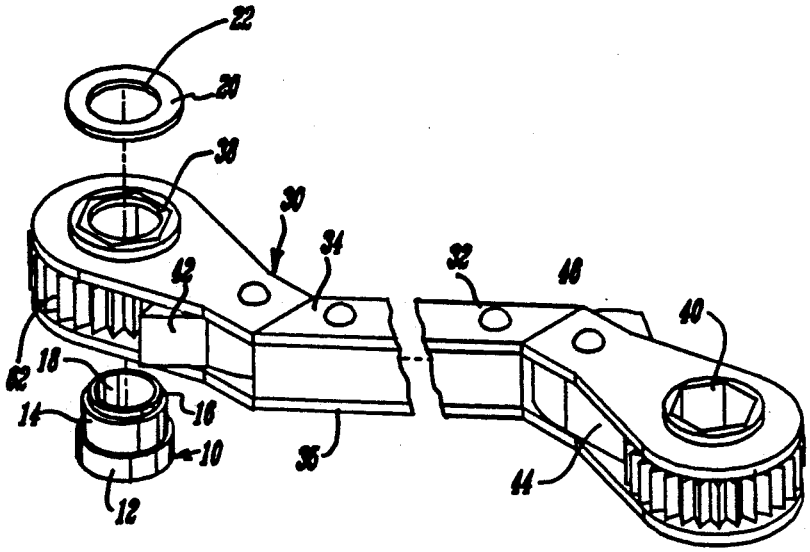
FIG. 1 is a perspective view of a box ratchet wrench with the ejector of the invention shown in exploded view.

Referring to FIG. 1, the ejector of the invention comprises two components. The first component is a cylindrical ejector member 10 which has a large diameter base 12, and intermediate neck 14, and an upper neck 16, each being of successively lesser diameter. The cylindrical ejector member 10 can be a solid cylinder, but preferably is hollow form, i.e., a cylindrical sleeve with an internal through aperture 18.

The second component of the ejector of the invention is a ring 20 having a central aperture 22 with an internal diameter closely mating the diameter of the upper neck 16, and with an outer diameter at least equal to the diameter of the base 12 and, preferably, substantially greater than base the diameter of base 12.

The two components of the ejector are assembled together about a socket sleeve 38 to retrofit an existing box ratchet wrench 30. This wrench is of conventional construction with a body 32 that is formed of a central core which is retained between outer handle plates 34 and 35. At each end of body 32, the wrench 30 distally supports a rotatable socket sleeve, 38 and 40. The socket sleeves are surrounded by integral ratchet rings such as 62 that are engaged by pawls 42 and 44. These pawls are pivotally supported in the assembly by rivets 46. In this fashion the pawls can be pivoted into positions engaging the ratchet teeth surrounding each socket sleeve to restrain the member against either clockwise or counterclockwise rotation.

Figure 2:
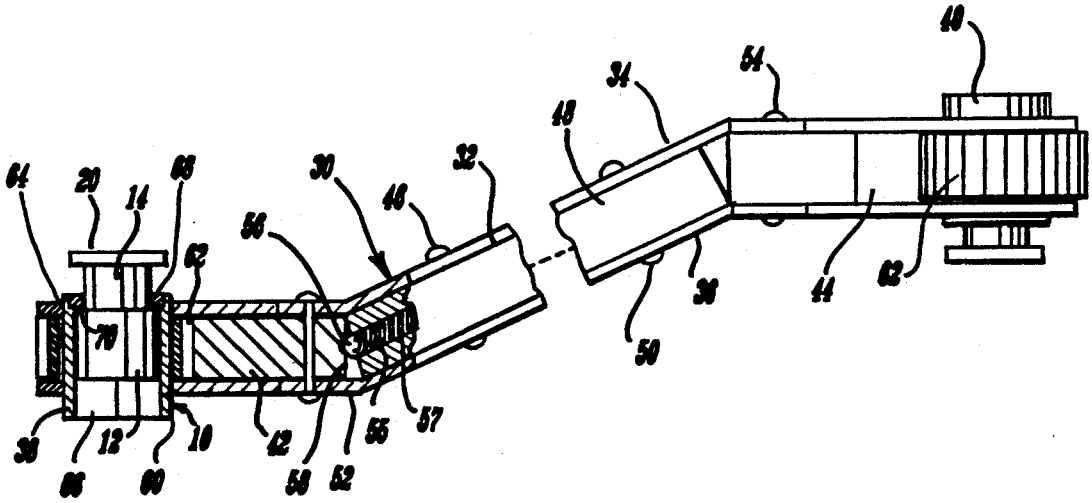
FIG. 2 is an elevational view, partially in section, of the wrench of FIG. 1.

Referring now to FIG. 2, the structure of the box ratchet wrench 30 and the cylindrical ejector member 10 of the invention will be described in greater detail. As previously mentioned, the wrench body 32 is formed of outer handle plates, such as 34, which are laminated onto a central core 48 and secured by rivets 46 and 50. The handle plates are provided with an obtuse angular bend at each end, e.g., at 36, thereby providing angularly offset wrenching ends 52 and 54. The central core 48 distally supports detents 56 which are slidably received in receiving bores 55 in the opposite ends of the central core 48 and which are resiliently biased outwardly by resilient means such as a compression spring 57 in each of the receiving bores. In this fashion, the detents 56 are resiliently urged against the arcuate shoulders such as 58 of each of the pawls 42 and 44.

The wrenching ends, 52 and 54, rotatably receive socket sleeves 38 and 40, respectively. Each socket sleeve is a cylindrical sleeve 60 which is surrounded by a ratchet ring 62 having external gear teeth. The ratchet ring 62 is permanently secured to the socket sleeve. The socket sleeve 60 is received within aligned distal apertures such as 64 in each of the outer handle plates, such as 34. The internal wall of the socket sleeve 60 is broached with one or more flats 66, typically in a conventional hexagonal cross section. One end of socket sleeve 60 receives ring 68 which is permanently secured thereto, thereby forming an internal annular lip 70.

While the aforementioned construction is conventional in the box ratchet wrench, my invention is applied to this construction to incorporate an ejector formed of cylindrical ejector member 10 and ring 20. The ejector member 10 is slidably received within sleeve 60 with its base portion 12 entirely received within sleeve 60 and with its reduced diameter neck 14 extending through the ring 68. The ring 20 is permanently secured to reduced diameter neck 16 (see FIG. 1) of ejector member 10, thereby capturing the ring 68 between the annular shoulder of the base 14 and the ring 20. In this fashion, the ejector member 10 of the invention is retained within the socket sleeve 38.

Figure 3:
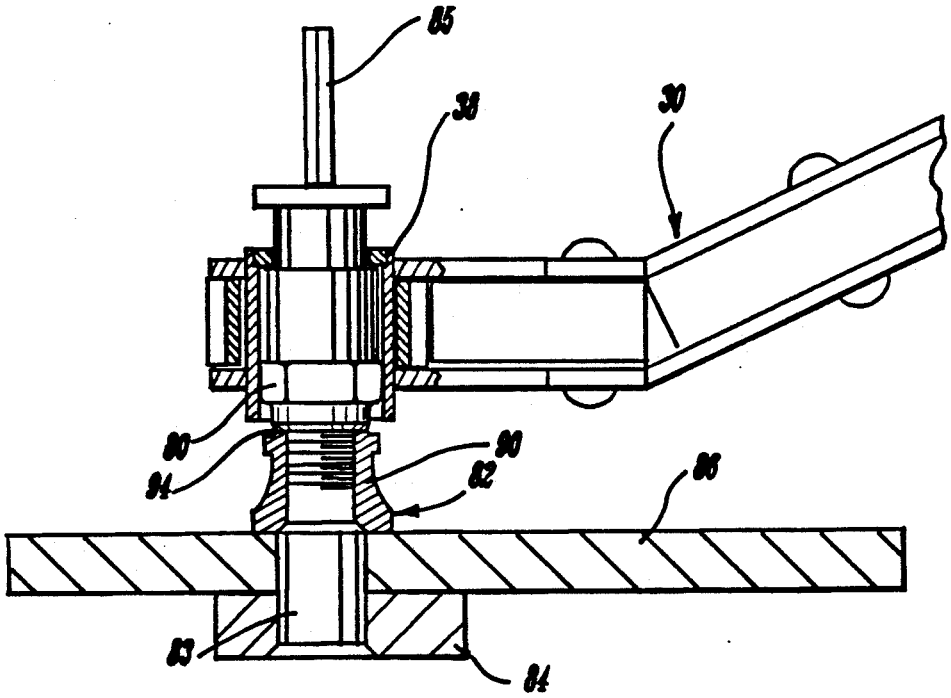
FIG. 3 is a sectional view of the modified wrench as applied to a hex collar of a frangible fastener.

Referring now to FIG. 3, the wrenching tool of the invention is shown for application of a frangible fastener. The wrench 30 receives within its socket sleeve 38, the narrow hexagonal wrenching ring 80 of a wrenching fastener 82 that is engaged with a cooperative bolt 83. The bolt 83 is received through work plates 84 and 86. As thus illustrated, the wrenching collar 80 is engaged in the socket sleeve 38.

The frangible fastener 82 is a conventional design in which the wrenching hex collar 80 is formed on a fastener ring 90. The fastener 82 has a groove 94 between fastener ring 90 and hex collar 80 to provide a strain relieved neck which will permit the hex collar to shear from the fastening ring 90 when the application torque reaches a predetermined value. The wrench 30 is used for this application to secure the fastener in an interference or a noninterference fit. In noninterference fit applications, a supplemental tool 85 such as a hex key or Allen wrench, is inserted into a hex recess in the end of the bolt 83 to immobilize the bolt during application of the fastener 82.

Figure 4:
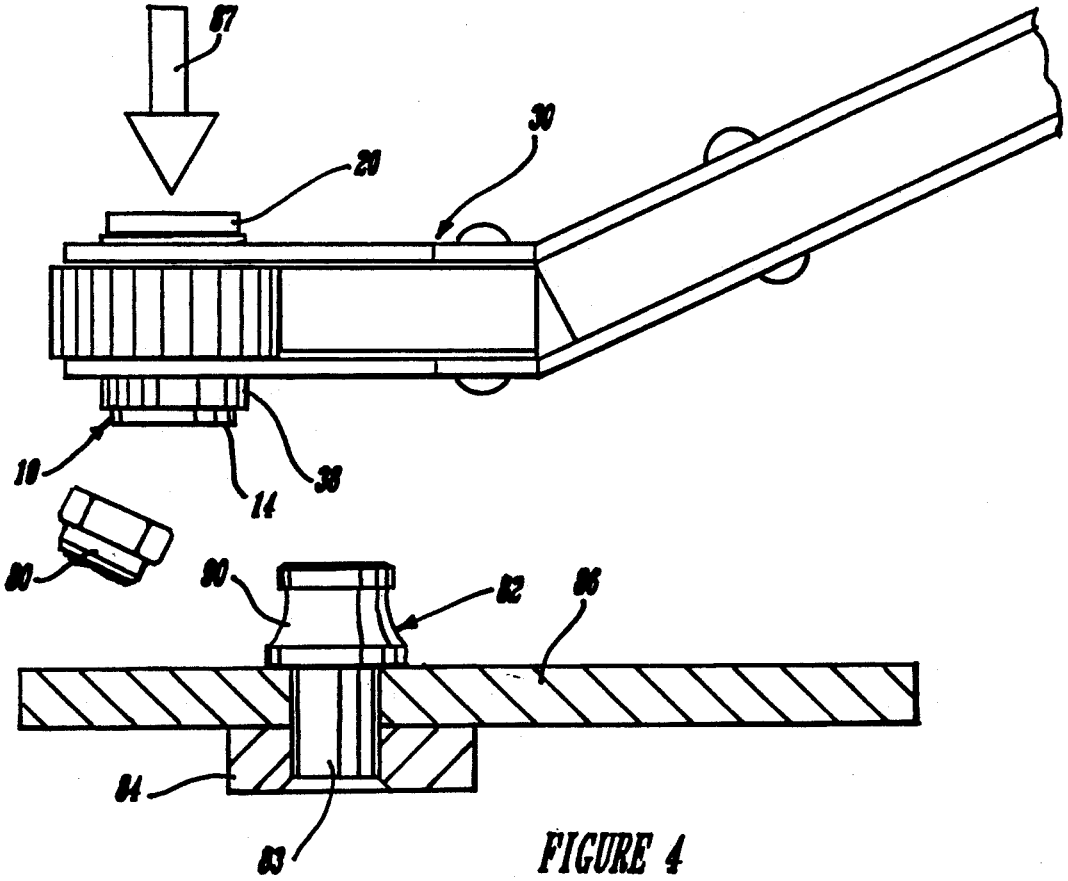
FIG. 4 is a sectional view of the fastener after its hex collar has been severed with the wrench and hex collar shown removed from the fastener.

Referring now to FIG. 4, the fastener 82 is shown in its assembled condition after the applied torque has been sufficient to sever the hex collar 80. As there illustrated, the fastener ring 90 is firmly secured against work piece 86, and the wrench 30 has been moved from the assembly, carrying with it the wrenching collar.

The hex collar 80 is readily displaced from the wrench 30 by the application of an axial force (shown by arrowhead line 87) to ring 20 of the ejector member 10, which advances the cylindrical base 12 downwardly in the assembly, ejecting the narrow hex collar 80 from the socket sleeve 38. The cylindrical ejector member is retained, however, in the assembly by ring 20 which is permanently secured to the cylindrical ejector member 10.

Figure 5:
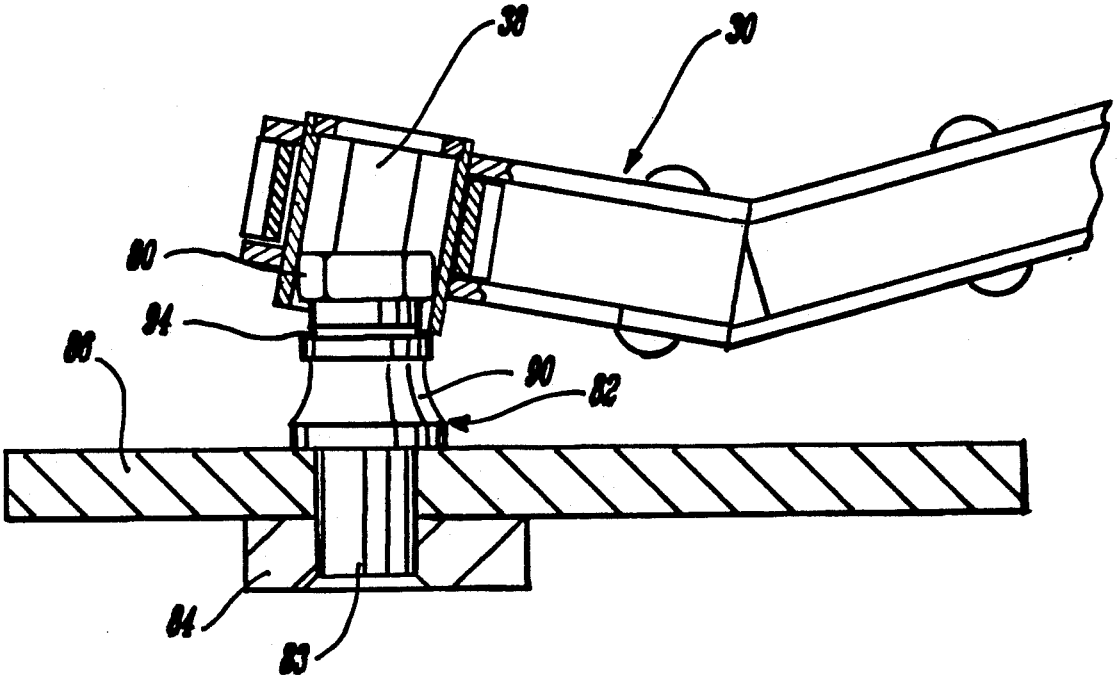
FIG. 5 illustrates a box ratchet wrench without the ejector of the invention receiving a hex collar of a frangible fastener in a canted position.

The invention can thus be seen to provide a very facile means for ejecting the narrow hex collars of frangible fasteners from socket sleeves of hand tools used for application of the frangible fasteners. The invention provides a simple and direct modification of existing socket wrenches to the application of frangible fasteners. In addition to serving as a simple ejector for the severed wrenching collars of frangible fasteners, the ejector member also serves to prevent jamming of the wrenching collar within the socket sleeve 38. Jamming can readily occur with the conventional socket sleeves as these socket sleeves are quite deep and the wrenching collar is quite narrow. As apparent from FIG. 4, the wrenching collar is spaced a substantial distance above the work piece and, accordingly, there is no stabilizing planer surface of the work piece to orient the wrench to the wrenching collar. Under these conditions, the wrenches are often applied at a position canted to the normal position to the wrenching collar; see FIG. 5. The canting of the wrench 30 can often occur in these applications, particularly when sufficient force is applied to sever the wrenching collar 80 from the locking sleeve, with the result that the wrenching collar becomes severely jammed in the deep socket 38 requiring time and attention of the user for its ejection. In contrast, the wrench which is retrofitted with the ejector members of the invention is provided with a very stable planer surface, the undersurface of cylindrical base 12 of ejector member 10, which bears against the upper surface of the wrenching ring 80, preventing it from becoming canted in the socket and jammed when it is severed from the fastener ring 90.

The invention thus provides two very significant improvements over the prior art. It prevents jamming of the frangible fastener within the socket sleeve and it permits very speedy and facile ejection of the locking collar once it has been severed from the frangible fastener.

The invention has been described with reference to the illustrated and presently preferred embodiment. The invention is applicable to a wide variety of socket sleeves in wrenches of other design and construction. It is not intended that the invention be unduly restricted by this illustration of the presently preferred embodiment. Instead, the invention is intended to be defined by the means, and their obvious equivalents, set forth in the following claims.

What is claimed is:

1. The combination of a socket wrench adapted for application of torque limiting frangible fasteners having a flatted wrenching collar of narrow height, said wrench having at least one socket sleeve of substantially greater depth than the height of said wrenching collar distally carried on a wrench body with a through aperture having unbroken, smooth-walled indexing flats for mating with said flatted wrenching collar and with an internal lip at one end thereof, and;

a. a cylindrical member having a cylindrical body with an external diameter closely conforming to the internal diameter of said socket sleeve and a length sufficient to fill at least 50 percent of the depth of said socket sleeve and leave an unfilled depth substantially equal to the height of said narrow collar, said member being slidably received within said socket sleeve and having a reduced diameter neck at one end to form an annular shoulder with said cylindrical body, and said neck having a length at least equal to the width of said narrow wrenching collar; and b. A ring permanently secured to the outer end of said reduced diameter neck whereby said internal lip of said socket sleeve is captured between said annular shoulder and said ring, thereby slidably retaining said cylindrical member in said socket sleeve.

2. The socket wrench of claim 1 wherein said cylindrical member is a hollow sleeve.

3. The socket wrench of claim 2 wherein said annular shoulder is axially spaced from said ring by a distance substantially greater than the thickness of said internal lip to permit axial sliding of said cylindrical member in said socket sleeve.

4. The socket wrench of claim 1 wherein said socket sleeve is rotatably carried on said wrench body.

5. The socket wrench of claim 1 including ratchet teeth disposed about the exterior of said socket sleeve and a cooperative pawl carried by said wrench body.

6. The socket wrench of claim 5 including spring means biasing said cooperative pawl into engagement with said ratchet teeth.

7. The socket wrench of claim 5 wherein said cooperative pawl is pivotally mounted in said wrenching body for reversal between positions engaging said ratchet teeth against clockwise, and counterclockwise rotation.

8. A socket sleeve and adapter received within said socket sleeve to adapt said socket sleeve for for application of torque limiting frangible fasteners having a flatted wrenching collar of narrow height, which comprises:

a: a socket sleeve having substantially greater depth than the width of said wrenching collar, and a through aperture with indexing flats on its internal wall for mating with said wrenching collar and an internal lip at one end thereof; and b: a cylindrical adapter member having an external diameter closely conforming to the internal diameter of said aperture of said socket sleeve and received therein, and having a length at least equal to 50 percent of the depth of said socket sleeve and leaving an unfilled depth substantially equal to the height of said narrow collar, said adapter member being slidably received within said socket sleeve and having a neck of a reduced diameter to provide an exterior annular shoulder and a length at least equal to the height of said narrow collar; and c: a ring permanently secured to the outer end of said neck whereby said internal lip of said socket sleeve is captured between said annular shoulder and said ring, thereby slidably retaining said cylindrical adapter member in said socket sleeve.

9. The socket wrench of claim 8 wherein said annular shoulder is axially spaced from said ring be a distance substantially greater than the thickness of said internal lip to permit axial sliding of said cylindrical member in said socket sleeve.

* * * * *